US010954959B2

(12) United States Patent
Yamada et al.

(10) Patent No.: US 10,954,959 B2
(45) Date of Patent: Mar. 23, 2021

(54) COMPRESSOR, UPPER HALF ASSEMBLY OF THE COMPRESSOR, UPPER HALF DIAPHRAGM OF THE COMPRESSOR, AND COMPRESSOR ASSEMBLING METHOD

(71) Applicant: MITSUBISHI HEAVY INDUSTRIES COMPRESSOR CORPORATION, Tokyo (JP)

(72) Inventors: Hideki Yamada, Hiroshima (JP); Jun Koyanagi, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 272 days.

(21) Appl. No.: 16/116,242

(22) Filed: Aug. 29, 2018

(65) Prior Publication Data

US 2019/0072108 A1 Mar. 7, 2019

(30) Foreign Application Priority Data

Sep. 5, 2017 (JP) ..... JP2017-170116

(51) Int. Cl.

| | |
|---|---|
| ***F04D 29/42*** | (2006.01) |
| ***F04D 17/12*** | (2006.01) |
| ***F04D 29/62*** | (2006.01) |
| ***F04D 29/28*** | (2006.01) |

(52) U.S. Cl.

CPC ..... *F04D 29/426* (2013.01); *F04D 17/12* (2013.01); *F04D 29/286* (2013.01); *F04D 29/42* (2013.01); *F04D 29/624* (2013.01); *F04D 29/628* (2013.01); *F04D 17/122* (2013.01)

(58) Field of Classification Search

None

See application file for complete search history.

(56) References Cited

U.S. PATENT DOCUMENTS 3,861,827 A * 1/1975 Peabody ..... F01D 25/246 415/209.2

4,380,405 A 4/1983 Kaneki et al.

(Continued)

FOREIGN PATENT DOCUMENTS

DE 1428069 A1 11/1968

EP 3492710 A1 6/2019

(Continued)

*Primary Examiner* — David Hamoui

*Assistant Examiner* — Jason Fountain

(74) *Attorney, Agent, or Firm* — Osha Bergman Watanabe & Burton LLP

(57) ABSTRACT

A compressor includes: an upper half casing having upper half casing parting planes; upper half diaphragms configured to be disposed on an inner circumferential side of the upper half casing and having upper half diaphragm parting planes; and upper half position regulating parts that regulate positions of the upper half casing and the upper half diaphragms. The upper half position regulating parts are fixed to at least one of the upper half casing and one of the upper half diaphragms, and have upper half abutting members at which upper half abutting surfaces, each of which comes into contact with an upper half casing recessed surface of the upper half casing and an upper half diaphragm recessed surface of the upper half diaphragm, are formed.

3 Claims, 6 Drawing Sheets

(56) References Cited

U.S. PATENT DOCUMENTS

| | | | | |
|---|---|---|---|---|
| 5,709,388 | A * | 1/1998 | Skinner | F01D 11/025 277/412 |
| 6,695,316 | B2 * | 2/2004 | Popa | F16J 15/442 277/411 |
| 9,500,130 | B2 * | 11/2016 | Swan | F02C 7/20 |
| 2015/0030444 | A1 | 1/2015 | Meyer et al. | |
| 2016/0305287 | A1 | 10/2016 | Honda et al. | |
| 2018/0017073 | A1 | 1/2018 | Yamada | |

FOREIGN PATENT DOCUMENTS

| | | | |
|---|---|---|---|
| GB | 1523157 | A | 8/1978 |
| JP | 2014-129752 | A | 7/2014 |
| WO | 2014082802 | A1 | 6/2014 |
| WO | 2016120984 | A1 | 8/2016 |

* cited by examiner

COMPRESSOR, UPPER HALF ASSEMBLY OF THE COMPRESSOR, UPPER HALF DIAPHRAGM OF THE COMPRESSOR, AND COMPRESSOR ASSEMBLING METHOD

CROSS-REFERENCE TO RELATED APPLICATIONS

Priority is claimed on Japanese Patent Application No. 2017-170116, filed Sep. 5, 2017, the content of which is incorporated herein by reference.

BACKGROUND

Technical Field

The present disclosure relates to a compressor, an upper half assembly of the compressor, an upper half diaphragm of the compressor, and a compressor assembling method.

Description of Related Art

Centrifugal compressors force a gas to pass through rotating impellers in a radial direction, and compress the gas using a centrifugal force generated at that time. Among centrifugal compressors, a multistage type centrifugal compressor that includes the impellers in multiple stages in an axial direction and compresses the gas step by step is known.

In this centrifugal compressor, there is a structure that has diaphragms in a casing. For example, in a multistage centrifugal compressor disclosed in Patent Document 1, a plurality of diaphragms connected in an axial direction are housed in a casing. In the multistage centrifugal compressor, a rotor is disposed to pass through the diaphragms.

Meanwhile, in the casing and diaphragms, a structure that can be parted by a parting plane spread in a horizontal direction may be adopted. In this case, the casing and diaphragms are each made up of an upper half part and a lower half part. When an upper half assembly into which the upper half parts of the casing and diaphragms are put together and a lower half assembly into which the lower half parts of the casing and diaphragms are put together are assembled, there is a need to assemble the upper half assembly and the lower half assembly such that no gap occurs between the upper half assembly and the lower half assembly. Especially, in the diaphragms in which the rotor is disposed, there is a need to bring the parting plane for the upper half diaphragms and the parting plane for the lower half diaphragms into close contact with each other with no gap and to secure sealability.

[Patent Document 1] Japanese Unexamined Patent Application, First Publication No. 2014-129752

However, when the upper half assembly and the lower half assembly are assembled, in a case in which the parting planes for the casing come into contact with each other first, there is a possibility of a gap occurring between the parting planes for the upper half diaphragms and the lower half diaphragms. For this reason, it is desirable to suppress the occurrence of a gap between the parting planes for the diaphragms and to assemble the upper half assembly and the lower half assembly.

The present disclosure was made in response to this demand, and an object thereof is to provide a compressor capable of suppressing occurrence of a gap between parting planes for diaphragms when assembled, an upper half assembly of the compressor, an upper half diaphragm of the compressor, and a compressor assembling method.

SUMMARY

A compressor according to a first aspect of the present disclosure includes: an upper half casing extending in a circumferential direction of a rotor that is rotatable about an axis and having upper half casing parting planes that are horizontal planes directed downward in a vertical direction at opposite ends thereof in the circumferential direction; a lower half casing extending in the circumferential direction and having lower half casing parting planes that is capable of coming into contact with the upper half casing parting planes at opposite ends thereof in the circumferential direction; upper half diaphragms extending in the circumferential direction, capable of being disposed on an inner circumferential side of the upper half casing, and having upper half diaphragm parting planes that are horizontal planes directed downward in the vertical direction at opposite ends thereof in the circumferential direction; lower half diaphragms extending in the circumferential direction, capable of being disposed on an inner circumferential side of the lower half casing, and having lower half diaphragm parting planes that is capable of coming into contact with the upper half diaphragm parting planes at opposite ends thereof in the circumferential direction; and upper half position regulating parts configured to regulate positions of the upper half casing and the upper half diaphragms in a state in which the upper half diaphragm parting planes are movable relative to the upper half casing parting planes to protrude in the vertical direction. The upper half casing has upper half casing recesses that are recessed upward on inner circumferential sides of the upper half casing parting planes in the vertical direction such that upper half casing recessed surfaces directed in a direction including the vertical direction are formed, and each of the upper half diaphragms has upper half diaphragm recesses that are recessed upward on outer circumferential sides of the upper half diaphragm parting planes in the vertical direction such that upper half diaphragm recessed surfaces directed in the direction including the vertical direction are formed, and that form housing spaces communicating with the upper half casing recesses when disposed on the inner circumferential side of the upper half casing. The upper half position regulating parts are fixed to at least one of the upper half casing and one of the upper half diaphragms in the housing spaces, and have upper half abutting members at which upper half abutting surfaces, each of which comes into contact with the upper half casing recessed surface and the upper half diaphragm recessed surface, are formed.

With this configuration, the upper half abutting members causes the upper half diaphragm parting planes to be movable relative to the upper half casing parting planes to protrude in the vertical direction. That is, in a state in which the upper half casing and the upper half diaphragms are assembled together, the upper half diaphragms are configured to be movable relative to the upper half casing. In this state, an upper half assembly and a lower half assembly are combined, so that the upper half diaphragms are lowered due to deadweight, and the upper half diaphragm parting planes protrude downward from the upper half casing parting planes in the vertical direction. For this reason, when the upper half assembly is placed on the lower half assembly, the lower half diaphragm parting planes and the upper half diaphragm parting planes can be brought into contact with each other before the lower half casing parting planes and the upper half casing parting planes come into contact with each other. As a result, in a state in which the upper half diaphragm parting planes and the lower half diaphragm parting planes are reliably in contact with each other, the upper half casing parting planes and the lower half casing parting planes come into contact with each other, and the upper half assembly and the lower half assembly are combined. Therefore, by merely placing the upper half assembly on the lower half assembly, the lower half diaphragm parting planes and the upper half diaphragm parting planes as well as the lower half casing parting planes and the upper half casing parting planes can come into contact with each other with high accuracy.

In a compressor according to a second aspect of the present disclosure, in the first aspect, the upper half abutting members may be fixed to the upper half casing in a state in which each of the upper half abutting surfaces is in contact with the upper half casing recessed surface and makes a gap with respect to the upper half diaphragm recessed surface.

With this constitution, the upper half casing recessed surfaces are made immovable relative to the upper half abutting surfaces, and the upper half diaphragm recessed surfaces are made movable relative to the upper half abutting surfaces. Thereby, due to the upper half abutting members, the upper half diaphragm parting planes are kept movable relative to the upper half casing parting planes to protrude in the vertical direction. That is, by merely mounting the upper half abutting members on the upper half casing, the upper half diaphragms can be made movable relative to the upper half casing in a state in which the upper half casing and the upper half diaphragms are assembled together. Therefore, adjustment work for positioning becomes easy and can be performed by merely fixing the upper half abutting members.

In a compressor according to a third aspect of the present disclosure, in the second aspect, each of the upper half abutting members may be a bolt member in which the upper half abutting surface becomes a seating face, and may be inserted into and fixed in a bolt hole formed in the upper half casing recessed surface.

With this constitution, the relative movement of the upper half diaphragm recessed surfaces relative to the upper half casing recessed surfaces can be restricted using the seating faces of the bolt members. Thereby, the relative movement of the upper half diaphragm parting planes relative to the upper half casing parting planes in the vertical direction can be restricted by a simple configuration.

In a compressor according to a fourth aspect of the present disclosure, in any one of the first to third aspects, a depth of the upper half diaphragm recess may be deeper than that of the upper half casing recess.

With this configuration, the amount of the relative movement of the upper half diaphragm parting planes relative to the upper half casing parting planes in the vertical direction can be adjusted by the depth of the upper half diaphragm recess and the depth of the upper half casing recess.

An upper half assembly of a compressor according to a fifth aspect of the present disclosure includes: an upper half casing extending in a circumferential direction of a rotor that is rotatable about an axis and having upper half casing parting planes that are horizontal planes directed downward in a vertical direction at opposite ends thereof in the circumferential direction; upper half diaphragms extending in the circumferential direction, disposed on an inner circumferential side of the upper half casing, and having upper half diaphragm parting planes that are horizontal planes directed downward in the vertical direction at opposite ends thereof in the circumferential direction; and upper half position regulating parts configured to regulate position of the upper half diaphragms relative to the upper half casing and in a state in which the upper half diaphragm parting planes are movable relative to the upper half casing parting planes to protrude in the vertical direction. The upper half casing has upper half casing recesses that are recessed upward on inner circumferential sides of the upper half casing parting planes in the vertical direction such that upper half casing recessed surfaces directed in a direction including the vertical direction are formed, and each of the upper half diaphragms has upper half diaphragm recesses that are recessed upward on outer circumferential sides of the upper half diaphragm parting planes in the vertical direction such that upper half diaphragm recessed surfaces directed in the direction including the vertical direction are formed, and that form housing spaces communicating with the upper half casing recesses when disposed on the inner circumferential side of the upper half casing. The upper half position regulating parts are fixed to at least one of the upper half casing and one of the upper half diaphragms in the housing spaces, and have upper half abutting parts at which upper half abutting surfaces, each of which comes into contact with the upper half casing recessed surface and the upper half diaphragm recessed surface, are formed.

An upper half diaphragm of a compressor according to a sixth aspect of the present disclosure is the upper half diaphragm configured to be disposed on an inner circumferential side of an upper half casing that extends in a circumferential direction of a rotor that is rotatable about an axis and has upper half casing parting planes that are horizontal planes directed downward in a vertical direction at opposite ends thereof in the circumferential direction, and is movable relative to the upper half casing to protrude in the vertical direction. The upper half diaphragm includes: an upper half diaphragm body extending in the circumferential direction and having upper half diaphragm parting planes that are horizontal planes directed downward in the vertical direction at opposite ends thereof in the circumferential direction; and upper half diaphragm recesses recessed upward on outer circumferential sides of the upper half diaphragm parting planes in the vertical direction such that upper half diaphragm recessed surfaces directed in a direction including the vertical direction are formed. The upper half diaphragm recesses are configured to form housing spaces that communicate with the upper half casing recesses of the upper half casing recessed upward on inner circumferential sides of the upper half casing parting planes when the upper half diaphragm body is disposed on the inner circumferential side of the upper half casing.

A compressor assembling method according to a seventh aspect of the present disclosure includes: an upper half casing preparing process of preparing an upper half casing extending in a circumferential direction of a rotor that is rotatable about an axis and having upper half casing parting planes that are horizontal planes directed downward in a vertical direction at opposite ends thereof in the circumferential direction; a lower half casing preparing process of preparing a lower half casing extending in the circumferential direction and having lower half casing parting planes that come into contact with the upper half casing parting planes at opposite ends thereof in the circumferential direction; an upper half diaphragm preparing process of preparing upper half diaphragms extending in the circumferential direction, capable of being disposed on an inner circumferential side of the upper half casing, and having upper half diaphragm parting planes that are horizontal planes directed downward in the vertical direction at opposite ends thereof in the circumferential direction; a lower half diaphragm preparing process of preparing lower half diaphragms extending in the circumferential direction, capable of being disposed on an inner circumferential side of the lower half casing, and having lower half diaphragm parting planes that come into contact with the upper half diaphragm parting planes at opposite ends thereof in the circumferential direction; an upper half assembling process of mounting upper half position regulating parts, which keep the upper half casing and the upper half diaphragms movable relative to each other such that the upper half diaphragm parting planes protrude in the vertical direction with respect to the upper half casing parting planes after the upper half diaphragms are disposed on the inner circumferential side of the upper half casing, on at least one of the upper half casing and one of the upper half diaphragms and forming an upper half assembly; a lower half assembling process of disposing the lower half diaphragms on the inner circumferential side of the lower half casing and forming a lower half assembly; and a final assembling process of bringing the upper half diaphragm parting planes into contact with the lower half diaphragm parting planes and installing the upper half assembly on the lower half assembly.

According to the present disclosure, occurrence of a gap between parting planes of each diaphragm is suppressed to enable assembly.

DETAILED DESCRIPTION

Hereinafter, an embodiment of the present disclosure will be described with reference to FIGS. 1 to 5.

Figure 1:
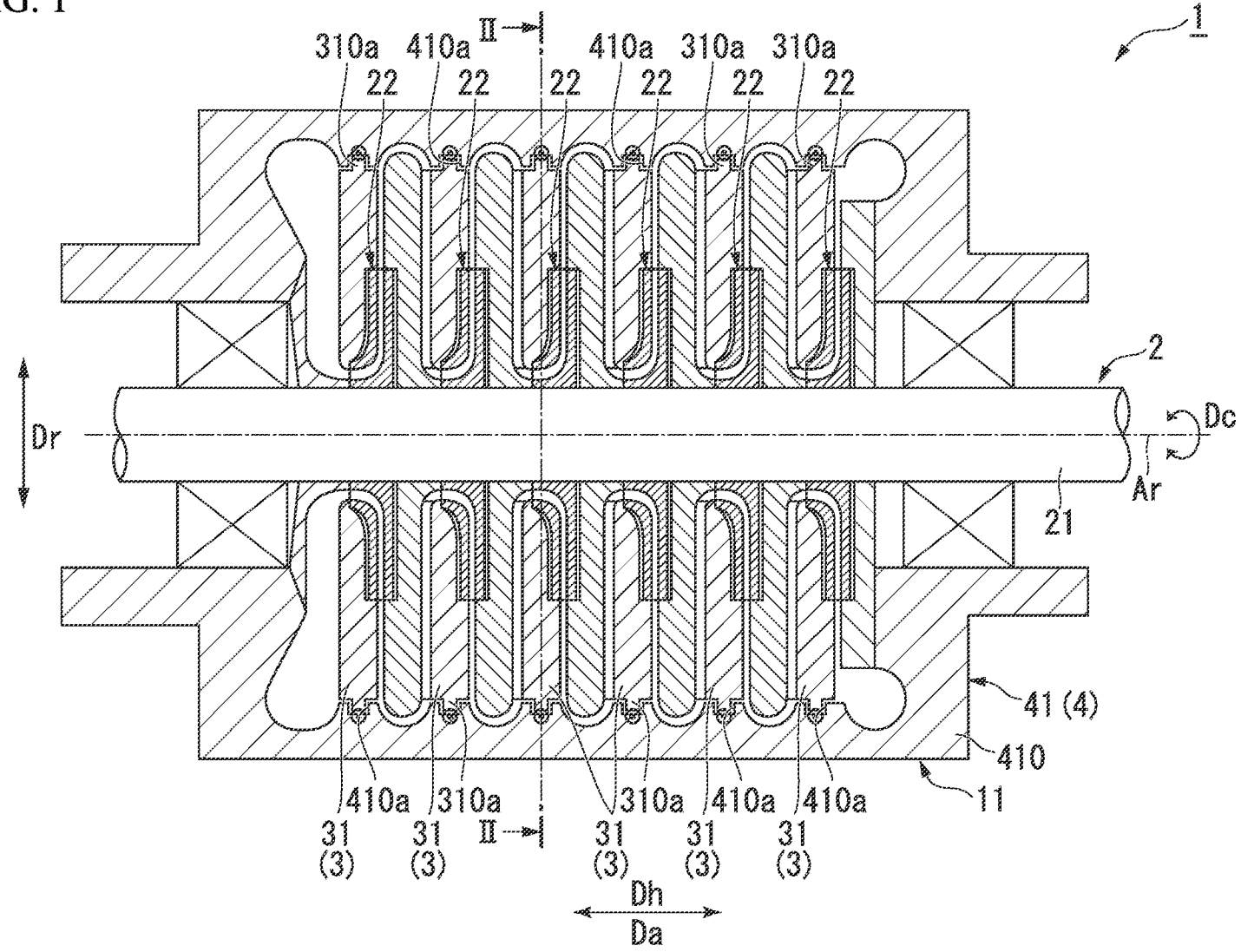
FIG. 1 is a sectional view showing a cross section of a centrifugal compressor of an embodiment of the present disclosure from below in a vertical direction.
Figure 2:
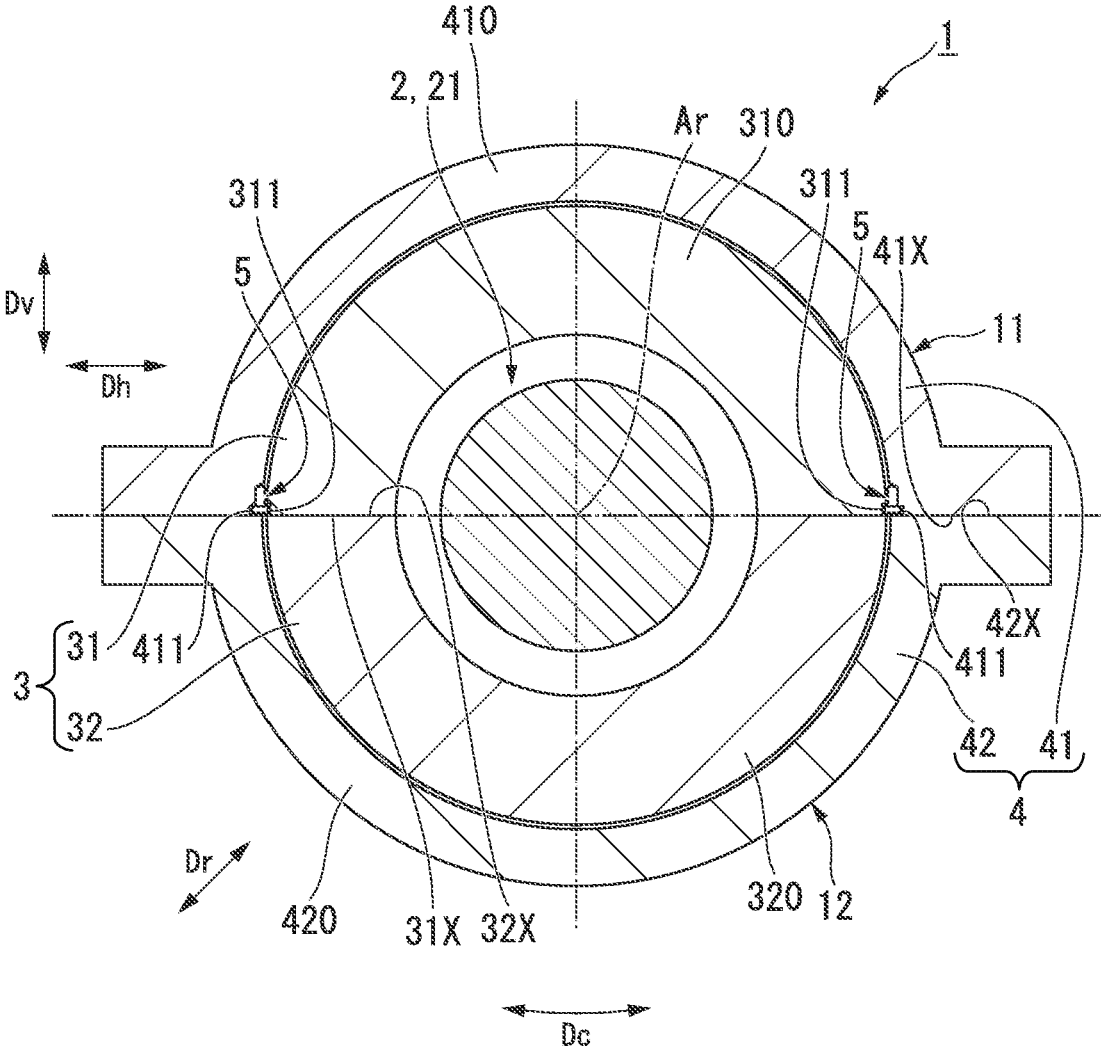
FIG. 2 is a schematic sectional view of the centrifugal compressor in which a rotor is simplified in a cross section taken along line II-II of FIG. 1.

As shown in FIG. 1, a rotary machine of the present embodiment is a single axis multistage type centrifugal compressor (a multistage centrifugal compressor) 1 having a plurality of impellers 22. As shown in FIGS. 1 and 2, the centrifugal compressor 1 of the present embodiment includes a rotor 2, diaphragms 3, a casing 4, and upper half vertical position regulating parts (upper half position regulating parts) 5.

The rotor 2 is rotatable about an axis Ar. The rotor 2 has a rotor shaft 21 that extends along the axis Ar in an axial direction Da, and a plurality of impellers 22 that rotate along with the rotor shaft 21.

Hereinafter, a direction in which the axis Ar extends is defined as an axial direction Da. A radial direction based on the axis Ar is simply defined as a radial direction Dr. An upward direction of the surface of the page of FIG. 2 within the radial direction Dr perpendicular to the axis Ar is defined as a vertical direction Dv. A leftward/rightward direction of FIG. 2 which is the radial direction Dr and the axial direction perpendicular to the axis Ar is defined as a horizontal direction Dh. A direction around the rotor 2 that centers on the axis Ar is defined as a circumferential direction Dc.

As shown in FIG. 1, the impellers 22 are fixed to an outer circumferential surface of the rotor shaft 21. The impellers 22 are rotated along with the rotor shaft 21, and thereby compress a process gas (a working fluid) using a centrifugal force. The impellers 22 are installed on the rotor shaft 21 in multiple stages in the axial direction Da. Each of the impellers 22 is a so-called close type impeller that includes a disc, a blade, and a cover.

The diaphragms 3 are disposed on an outer circumferential side of the rotor 2. Each of the diaphragms 3 has an annular shape centering on the axis Ar. The annular diaphragms 3 have upper half diaphragms 31 and lower half diaphragms 32 (see FIG. 2) in the vertical direction Dv on the basis of the axis Ar of the rotor 2. The upper half diaphragms 31 and the lower half diaphragms 32 will be described in detail below.

The casing 4 is disposed on outer circumferential sides of the diaphragms 3. The casing 4 has a tubular shape centering on the axis Ar. The tubular casing 4 has an upper half casing 41 and a lower half casing 42 (see FIG. 2) on the basis of the axis Ar of the rotor 2.

In the present embodiment, as shown in FIG. 2, the upper half casing 41 and the upper half diaphragms 31 are combined to form an upper half assembly 11. The lower half casing 42 and the lower half diaphragms 32 are combined to form a lower half assembly 12. The upper half assembly 11 is placed on the lower half assembly 12 to interpose the rotor 2 therebetween, and thereby the centrifugal compressor 1 is formed.

The upper half casing 41 extends in the circumferential direction Dc. Flanges that extend in the horizontal direction Dh are formed on opposite ends of the upper half casing 41 of the present embodiment in the circumferential direction Dc. The upper half casing 41 has upper half casing parting planes 41X on the opposite ends thereof in the circumferential direction Dc. The upper half casing parting planes 41X are parting planes of one side when the casing 4 is parted up and down in the vertical direction Dv. The upper half casing parting planes 41X are planes spread in the radial direction Dr and the axial direction Da. That is, the upper half casing parting planes 41X are horizontal planes directed downward in the vertical direction Dv. The upper half casing 41 of the present embodiment has an upper half casing body 410 and upper half casing recesses 411.

A cross section of the upper half casing body 410 which is perpendicular to the axis Ar has a semi-annular shape centering on the axis Ar. The upper half casing body 410 opens downward in the vertical direction Dv for the rotor 2 and the diaphragms 3 to be fitted thereinto. As shown in FIG. 1, a plurality of upper half positioning recesses 410*a*, each of which is recessed from an inner circumferential surface throughout the circumference, are formed in the upper half casing body 410. The upper half positioning recesses 410*a* are formed at central positions of the upper half casing body 410 in the axial direction Da.

As shown in FIG. 2, the upper half casing recesses 411 are symmetrically formed on the two upper half casing parting planes 41X separated in the horizontal direction Dh. Here, the upper half casing recess 411 on one side that is the right side of the surface of the page in FIG. 2 and is in the horizontal direction Dh will be described by way of example. The upper half casing recess 411, a description of which will be omitted, on the other side in the horizontal direction Dh also has the same shape.

Figure 3:
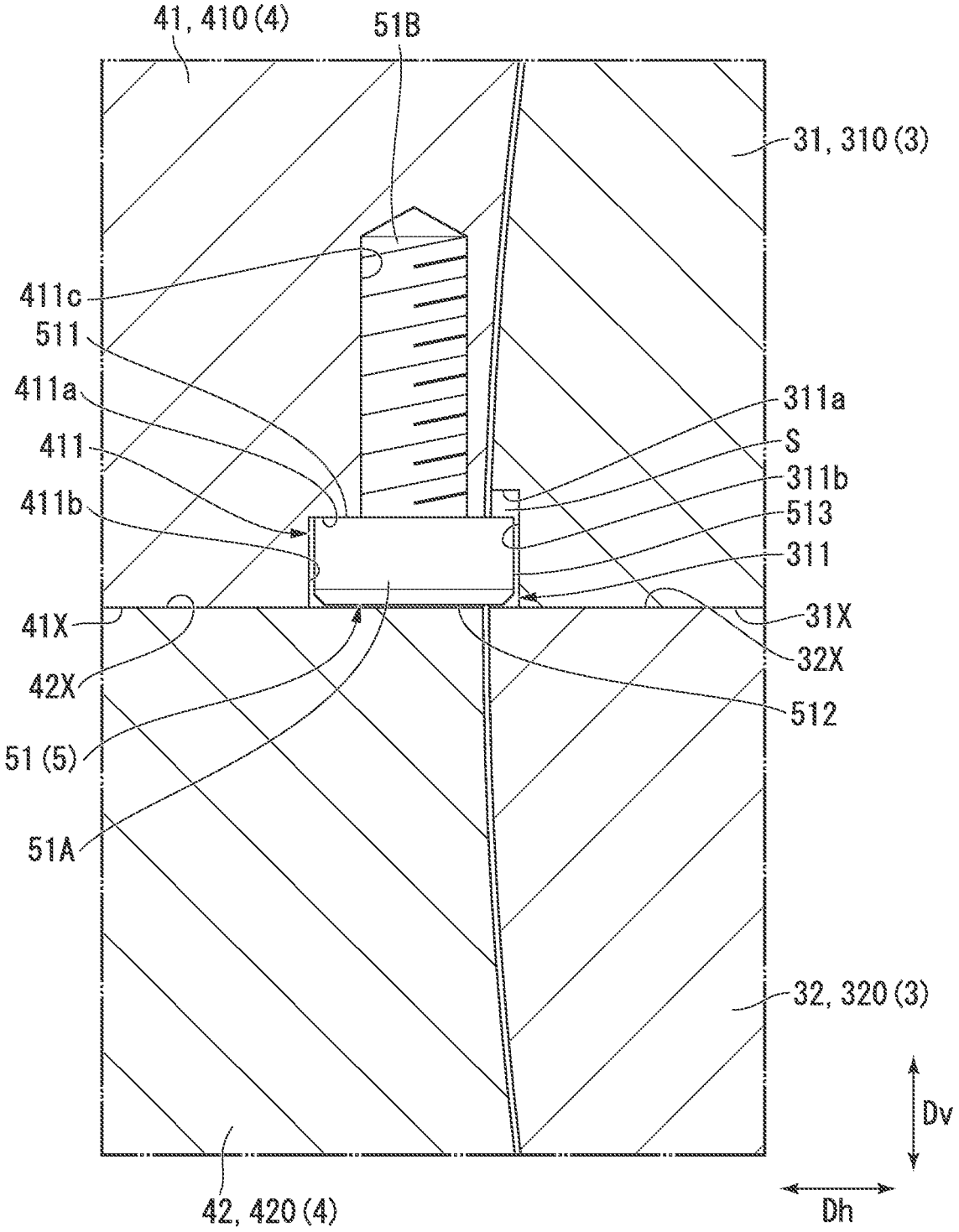
FIG. 3 is an enlarged sectional view of key parts showing upper half vertical position regulating parts of the embodiment of the present disclosure.
Figure 4:
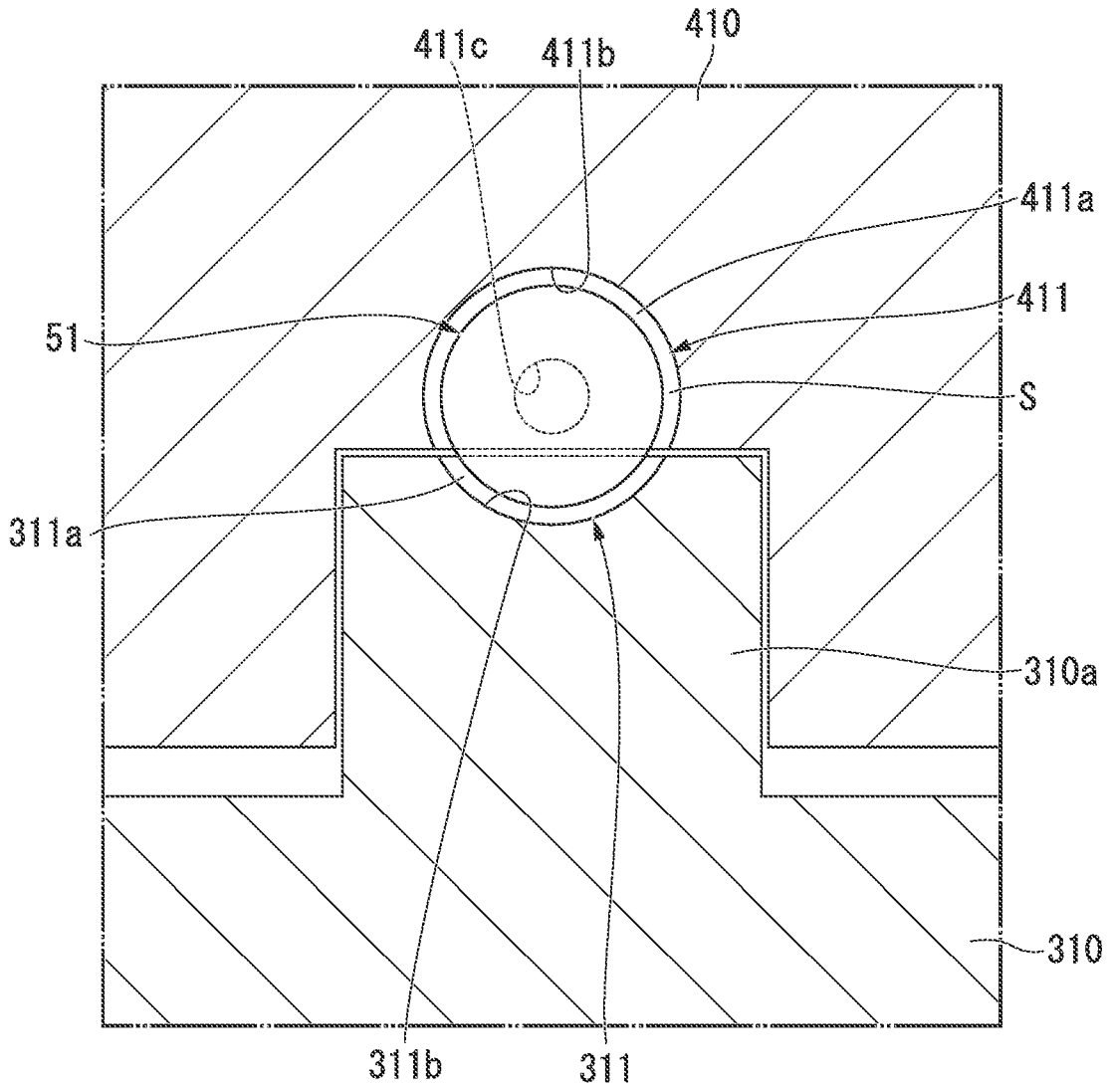
FIG. 4 is an enlarged view of key parts showing upper half vertical position regulating parts of the embodiment of the present disclosure.

As shown in FIG. 3, the upper half casing recess 411 is recessed from the upper half casing parting plane 41X. The upper half casing recess 411 is recessed upward on an inner circumferential side of the upper half casing parting plane 41X in the vertical direction Dv. The upper half casing recess 411 is formed in a corner formed by an inner circumferential surface in which the upper half positioning recesses 410*a* are formed and by the upper half casing parting plane 41X. As shown in FIGS. 1 and 4, the upper half casing recess 411 is recessed from the inner circumferential surface of the upper half casing body 410 to have an arc shape when viewed from the upper half casing parting plane 41X. As shown in FIG. 3, the upper half casing recess 411 has a first upper half casing flat surface (an upper half casing recessed surface) 411*a* directed in a direction including the vertical direction Dv, and a first upper half casing curved surface 411*b* that is directed inward in the radial direction Dr.

The first upper half casing flat surface 411*a* is a surface that is spread in the radial direction Dr and the axial direction Da toward the upper half casing parting plane 41X and directed in the direction including the vertical direction Dv. The first upper half casing flat surface 411*a* of the present embodiment is a horizontal surface that is directed downward in the vertical direction Dv. Therefore, the first upper half casing flat surface 411*a* is formed in parallel to the upper half casing parting plane 41X. A bolt hole 411*c* is formed in the first upper half casing flat surface 411*a*.

The first upper half casing flat surface 411*a* need only be a surface directed in the direction including the vertical direction Dv, and may be a flat surface directed in a direction that is inclined with respect to the vertical direction Dv.

The first upper half casing curved surface 411*b* connects the upper half casing parting plane 41X and the first upper half casing flat surface 411*a*. The first upper half casing curved surface 411*b* is spread in a direction perpendicular to the upper half casing parting plane 41X and the first upper half casing flat surface 411*a*. The first upper half casing curved surface 411*b* is a concave surface that is directed inward in the radial direction Dr in a cross section perpendicular to the axis Ar. The first upper half casing curved surface 411*b* extends from the upper half casing parting plane 41X in the vertical direction Dv.

As shown in FIG. 2, the lower half casing 42 extends in the circumferential direction Dc. Flanges that extend in the horizontal direction Dh are formed on opposite ends of the lower half casing 42 of the present embodiment in the circumferential direction Dc. The lower half casing 42 has lower half casing parting planes 42X on the opposite ends thereof in the circumferential direction Dc. The lower half casing parting planes 42X are parting planes of the other side when the casing 4 is parted up and down in the vertical direction Dv. The lower half casing parting planes 42X are planes spread in the radial direction Dr and the axial direction Da. That is, the lower half casing parting planes 42X are horizontal planes directed upward in the vertical direction Dv. The lower half casing 42 of the present embodiment has a lower half casing body 420.

A cross section of the lower half casing body 420 which is perpendicular to the axis Ar has a semi-annular shape centering on the axis Ar. An inner diameter of the lower half casing body 420 is formed in the same size as the upper half casing body 410. The lower half casing body 420 opens upward in the vertical direction Dv for the rotor 2 and the diaphragms 3 to be fitted thereinto. A plurality of lower half positioning recesses (not shown), each of which is recessed from an inner circumferential surface throughout the circumference, are formed in the lower half casing body 420 to correspond to the upper half positioning recesses 410*a*. The lower half positioning recesses are formed at central positions of the lower half casing body 420 in the axial direction Da in the same shape as the upper half positioning recesses 410*a*.

The upper half diaphragms 31 extend in the circumferential direction Dc. The upper half diaphragms 31 are configured to be disposed on an inner circumferential side of the upper half casing 41. Each of the upper half diaphragms 31 has upper half diaphragm parting planes 31X on the opposite ends thereof in the circumferential direction Dc. The upper half diaphragm parting planes 31X are parting planes of one side when each of the diaphragms 3 is parted up and down in the vertical direction Dv. The upper half diaphragm parting planes 31X are planes spread in the radial direction Dr and the axial direction Da. That is, the upper half diaphragm parting planes 31X are horizontal planes directed downward in the vertical direction Dv. The upper half diaphragm 31 of the present embodiment has an upper half diaphragm body 310 and upper half diaphragm recesses 311.

A cross section of the upper half diaphragm body 310 which is perpendicular to the axis Ar has a semi-annular shape centering on the axis Ar. The upper half diaphragm body 310 is configured to be housed in the opening portion of the upper half casing body 410 in a state in which a slight gap is provided on the inner circumferential surface side of the upper half casing body 410. The upper half diaphragm body 310 opens downward in the vertical direction Dv for the rotor 2 to be fitted thereinto. An outer diameter of the upper half diaphragm body 310 is formed to be slightly smaller than an inner diameter of the upper half casing body 410. The upper half diaphragm body 310 has a semi-elliptical shape in which a diameter thereof in the vertical direction Dv is slightly (e.g., about 1 mm) longer than that in the horizontal direction Dh. As shown in FIGS. 1 and 4, upper half spigot parts 310*a* that protrude from an outer circumferential surface throughout the circumference are formed in the upper half diaphragm bodies 310. Each of the upper half spigot parts 310*a* is formed at a central position of the upper half diaphragm body 310 in the axial direction Da. The upper half spigot parts 310*a* are fitted into the upper half positioning recesses 410*a*, and thereby a position of the upper half diaphragm 31 in the axial direction Da relative to the upper half casing 41 is defined.

As shown in FIG. 2, the upper half diaphragm recesses 311 are symmetrically formed on the two upper half diaphragm parting planes 31X separated in the horizontal direction Dh. Here, the upper half diaphragm recess 311 on one side that is the right side of the surface of the page in FIG. 2 and is in the horizontal direction Dh will be described by way of example. The upper half diaphragm recess 311, a description of which will be omitted, on the other side in the horizontal direction Dh also has the same shape.

As shown in FIG. 3, the upper half diaphragm recess 311 is recessed from the upper half diaphragm parting plane 31X. The upper half diaphragm recess 311 is recessed upward on an inner circumferential side of the upper half diaphragm parting plane 31X in the vertical direction Dv. The upper half diaphragm recess 311 is formed in a corner formed by an outer circumferential surface on which the upper half spigot parts 310*a* of the upper half diaphragm body 310 are formed and by the upper half diaphragm parting plane 31X. When the upper half diaphragm 31 is disposed on the inner circumferential side of the upper half casing 41, the upper half diaphragm recess 311 forms a housing space S that communicates with the upper half casing recess 411. Therefore, in the state in which the upper half diaphragm 31 is disposed on the inner circumferential side of the upper half casing 41, the upper half diaphragm recess 311 of the present embodiment is formed such that a position thereof in the circumferential direction Dc and the axial direction Da becomes the same position as the upper half casing recess 411. As shown in FIG. 4, the upper half diaphragm recess 311 is recessed from the upper half diaphragm body 310 to have an arc shape when viewed from the upper half diaphragm parting plane 31X side. Thereby, the upper half diaphragm recess 311 has a circular shape along with the upper half casing recess 411 when viewed from the upper half diaphragm parting plane 31X side. As shown in FIG. 3, a depth of the upper half diaphragm recess 311 of the present embodiment from the upper half diaphragm parting plane 31X is made deeper than that of the upper half casing recess 411 from the upper half casing parting plane 41X. The upper half diaphragm recess 311 has a first upper half diaphragm flat surface (upper half diaphragm recessed surface) 311*a* directed in the direction including the vertical direction Dv, and a first upper half diaphragm curved surface 311*b* that is directed outward in the radial direction Dr.

The first upper half diaphragm flat surface 311*a* is a surface that is spread in the radial direction Dr and the axial direction Da toward the upper half diaphragm parting plane 31X and directed in the direction including the vertical direction Dv. The first upper half diaphragm flat surface 311*a* of the present embodiment is a horizontal surface that is directed downward in the vertical direction Dv. Therefore, the first upper half diaphragm flat surface 311*a* is formed in parallel to the upper half diaphragm parting plane 31X. In a state in which the upper half diaphragm 31 is disposed on the inner circumferential side of the upper half casing 41 and the upper half diaphragm parting plane 31X and the upper half casing parting plane 41X are disposed on the same surface, the first upper half diaphragm flat surface 311*a* is formed to be located farther from the upper half diaphragm parting plane 31X than the first upper half casing flat surface 411*a*. That is, when the upper half assembly 11 is combined with the lower half assembly 12, the first upper half diaphragm flat surface 311*a* is located above the first upper half casing flat surface 411*a* in the vertical direction Dv.

The first upper half diaphragm flat surface 311*a* need only be a surface directed in the direction including the vertical direction Dv, and may be a flat surface directed in the direction that is inclined with respect to the vertical direction Dv.

The first upper half diaphragm curved surface 311*b* connects the upper half diaphragm parting plane 31X and the first upper half diaphragm flat surface 311*a*. The first upper half diaphragm curved surface 311*b* is spread in a direction perpendicular to the upper half diaphragm parting plane 31X and the first upper half diaphragm flat surface 311*a*. The first upper half diaphragm curved surface 311*b* is a concave surface that is directed outward in the radial direction Dr in the cross section perpendicular to the axis Ar. The first upper half diaphragm curved surface 311*b* extends from the upper half diaphragm parting planes 31X in the vertical direction Dv. The length of the first upper half diaphragm curved surface 311*b* in the vertical direction Dv is longer than that of the first upper half casing curved surface 411*b* in the vertical direction Dv.

As shown in FIG. 2, the lower half diaphragm 32 extends in the circumferential direction Dc. The lower half diaphragm 32 is configured to be disposed on the inner circumferential side of the lower half casing 42. The lower half diaphragm 32 has lower half diaphragm parting planes 32X on the opposite ends thereof in the circumferential direction Dc. The lower half diaphragm parting planes 32X are parting planes of the other side when the diaphragm 3 is parted up and down in the vertical direction Dv. The lower half diaphragm parting planes 32X are planes spread in the radial direction Dr and the axial direction Da. That is, the lower half diaphragm parting planes 32X are horizontal planes directed upward in the vertical direction Dv. The lower half diaphragm 32 of the present embodiment has a lower half diaphragm body 320.

A cross section of the lower half diaphragm body 320 which is perpendicular to the axis Ar has a semi-annular shape centering on the axis Ar. The lower half diaphragm body 320 is configured to be housed in the opening portion of the lower half casing body 420 in a state in which a slight gap is provided on the inner circumferential surface side of the lower half casing body 420. The lower half diaphragm body 320 opens upward in the vertical direction Dv for the rotor 2 to be fitted thereinto. An outer diameter of the lower half diaphragm body 320 is formed to be slightly smaller than an inner diameter of the lower half casing body 420. The outer diameter of the lower half diaphragm body 320 is formed in the same size as the upper half diaphragm body 310. The lower half diaphragm body 320 has a semi-elliptical shape in which a diameter thereof in the vertical direction Dv is slightly (e.g., about 1 mm) longer than that in the horizontal direction Dh. A plurality of lower half spigot parts (not shown) that protrude from an outer circumferential surface throughout the circumference are formed in the lower half diaphragm bodies 320 to correspond to the upper half spigot parts 310*a*. Each of the lower half spigot parts is formed at a central position of the lower half diaphragm body 320 in the axial direction Da in the same shape as the upper half spigot parts 310*a*. The lower half spigot parts are fitted into the lower half positioning recesses, and thereby a position of the lower half diaphragm 32 in the axial direction Da relative to the lower half casing 42 is defined.

The upper half vertical position regulating parts 5 are provided in two places separated in the horizontal direction Dh. Here, the upper half vertical position regulating part 5 provided on one side that is the right side of the surface of the page in FIG. 2 and is in the horizontal direction Dh will be described by way of example. The upper half vertical position regulating part 5, a description of which will be omitted, on the other side in the horizontal direction Dh also has the same configuration.

As shown in FIG. 3, the upper half vertical position regulating part 5 regulates positions of the upper half casing 41 and the upper half diaphragm 31 in a state in which the upper half diaphragm parting plane 31X can move relative to the upper half casing parting plane 41X to protrude in the vertical direction Dv. The upper half vertical position regulating part 5 regulates relative movement between the upper half casing 41 and the upper half diaphragm 31 in a direction perpendicular to the upper half casing parting plane 41X and the upper half diaphragm parting plane 31X. That is, the upper half vertical position regulating part 5 regulates relative movement between the upper half casing 41 and the upper half diaphragm 31 in the vertical direction Dv. The upper half vertical position regulating part 5 of the present embodiment regulates a position of the upper half diaphragm 31 in the vertical direction Dv relative to the upper half casing 41. Thereby, the upper half vertical position regulating part 5 allows the upper half casing 41 and the upper half diaphragm 31 to perform the relative movement between a position at which the upper half diaphragm parting plane 31X protrudes in the vertical direction Dv relative to the upper half casing parting planes 41X and a position at which the upper half diaphragm parting plane 31X does not protrude (a position at which the upper half casing parting plane 41X protrudes in the vertical direction Dv relative to the upper half diaphragm parting plane 31X). The upper half vertical position regulating part 5 is provided in the housing space S. The upper half vertical position regulating part 5 has an upper half abutting member 51.

The upper half abutting member 51 is fixed to at least one of the upper half casing 41 and the upper half diaphragm 31 in the housing space S. The upper half abutting member 51 of the present embodiment is mounted on the upper half casing 41. The upper half abutting member 51 restricts an amount of relative movement of the first upper half diaphragm flat surface 311*a* relative to the first upper half casing flat surface 411*a* in the vertical direction Dv. The upper half abutting member 51 of the present embodiment prevents the first upper half diaphragm flat surface 311*a* from protruding further toward the upper half casing parting plane 41X than the first upper half casing flat surface 411*a*. The upper half abutting member 51 of the present embodiment is a bolt member. The upper half abutting member 51 has a head part 51A and a threaded part 51B.

The head part 51A is formed in such a size that it can be housed in the housing space S. The head part 51A has an upper half abutting surface 511 that faces the first upper half casing flat surface 411*a* and the first upper half diaphragm flat surface 311*a*, an upper half separating surface 512 that faces the opposite side at a position away from the upper half abutting surface 511, and an upper half connecting lateral surface 513 that connects the upper half abutting surface 511 and the upper half separating surface 512.

The upper half abutting surface 511 is configured to be coming into contact with the first upper half casing flat surface 411*a* and the first upper half diaphragm flat surface 311*a*. The upper half abutting surface 511 of the present embodiment is a seating face of the head part 51A of the bolt member. The upper half abutting surface 511 is a flat surface that is parallel to the first upper half casing flat surface 411*a* and the first upper half diaphragm flat surface 311*a*. The upper half abutting surface 511 has an annular shape.

The upper half separating surface 512 is a flat surface that is parallel to the upper half abutting surface 511. The upper half separating surface 512 of the present embodiment is a top face of the head part 51A of the bolt member. In the state in which the head part 51A is disposed in the housing space S, the upper half separating surface 512 is formed closer to the first upper half diaphragm flat surface 311*a* and the first upper half casing flat surface 411*a* than the upper half diaphragm parting plane 31X and the upper half casing parting plane 41X.

The upper half connecting lateral surface 513 is a lateral surface perpendicular to the upper half abutting surface 511 and the upper half separating surface 512. In the state in which the head part 51A is disposed in the housing space S, the upper half connecting lateral surface 513 is formed at a position at which a slight gap is formed between the first upper half diaphragm curved surface 311*b* and the first upper half casing curved surface 411*b*.

The threaded part 51B fixes the head part 51A to the upper half casing 41. The threaded part 51B is fixed in a state in which it is inserted into the bolt hole 411*c* formed in the first upper half casing flat surface 411*a*.

The upper half abutting member 51 is fixed to the upper half casing 41 such that the head part 51A does not stick out of the housing space S in a state in which the upper half diaphragm 31 is housed in the upper half casing 41 in a state in which the upper half diaphragm parting plane 31X and the upper half casing parting plane 41X directed upward in the vertical direction Dv. In this case, the upper half abutting surface 511 comes into contact with the first upper half casing flat surface 411*a* alone, and is disposed at a position at which a gap is formed from the first upper half diaphragm flat surface 311*a*. The upper half separating surface 512 is disposed at a position at which it does not stick out of the upper half diaphragm parting plane 31X and the upper half casing parting plane 41X.

Next, a compressor assembling method S1 for assembling the centrifugal compressor 1 will be described. In the present embodiment, the compressor assembling method S1 by which components are formed from the beginning, and are assembled to manufacture the centrifugal compressor 1 will be described. The compressor assembling method S1 is not limited to the case in which the centrifugal compressor 1 is manufactured from the beginning, and may be used when the centrifugal compressor 1 is disassembled and assembled again when repair or inspection is performed.

Figure 5:
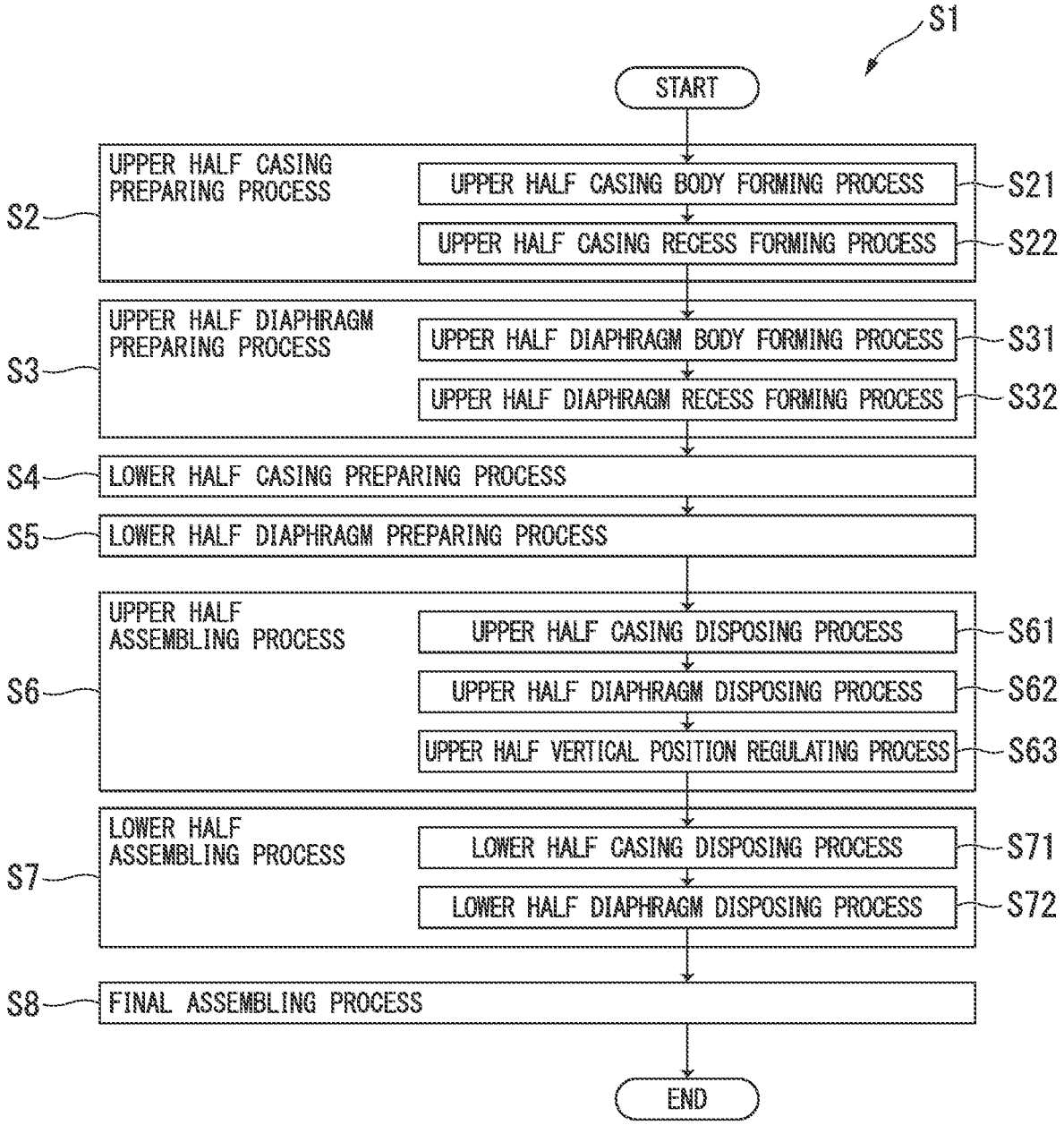
FIG. 5 is a flow chart of a compressor assembling method of the embodiment of the present disclosure.

As shown in FIG. 5, the compressor assembling method S1 of the present embodiment includes an upper half casing preparing process S2, an upper half diaphragm preparing process S3, a lower half casing preparing process S4, a lower half diaphragm preparing process S5, an upper half assembling process S6, a lower half assembling process S7, and a final assembling process S8.

In the upper half casing preparing process S2, the upper half casing 41 is prepared. In the upper half casing preparing process S2 of the present embodiment, the upper half casing 41 is formed, thereby being prepared. The upper half casing preparing process S2 has an upper half casing body forming process S21 and an upper half casing recess forming process S22.

In the upper half casing body forming process S21, the upper half casing body 410 is formed.

In the upper half casing recess forming process S22, the upper half casing recesses 411 are formed. The upper half casing recess forming process S22 is performed after the upper half casing body forming process S21. In the upper half casing recess forming process S22, the first upper half casing flat surfaces 411*a* are formed in parallel to the upper half casing parting planes 41X.

In the upper half diaphragm preparing process S3, the upper half diaphragms 31 are prepared. In the upper half diaphragm preparing process S3 of the present embodiment, the upper half diaphragms 31 are formed, thereby being prepared. The upper half diaphragm preparing process S3 has an upper half diaphragm body forming process S31 and an upper half diaphragm recess forming process S32.

In the upper half diaphragm body forming process S31, the upper half diaphragm body 310 is formed.

The upper half diaphragm recess forming process S32 is performed after the upper half diaphragm body forming process S31. In the upper half diaphragm recess forming process S32, the upper half diaphragm recesses 311 are formed. In the upper half diaphragm recess forming process S32, the first upper half diaphragm flat surfaces 311*a* are formed in parallel to the upper half diaphragm parting planes 31X.

In the lower half casing preparing process S4, the lower half casing 42 is prepared. In the lower half casing preparing process S4 of the present embodiment, the lower half casing 42 is formed, thereby being prepared. In the lower half casing preparing process S4 of the present embodiment, the lower half casing body 420 is formed.

In the lower half diaphragm preparing process S5, the lower half diaphragms 32 are prepared. In the lower half diaphragm preparing process S5, the lower half diaphragms 32 are formed, thereby being prepared. In the lower half diaphragm preparing process S5 of the present embodiment, the lower half diaphragm body 320 is formed.

The upper half casing preparing process S2, the upper half diaphragm preparing process S3, the lower half casing preparing process S4, and the lower half diaphragm preparing process S5 may be performed from any one of them, and the order of performing them may also be arbitrary. Therefore, these processes may be performed in parallel. In the upper half casing preparing process S2, the upper half diaphragm preparing process S3, the lower half casing preparing process S4, and the lower half diaphragm preparing process S5, each member may only be previously prepared without being formed.

The upper half assembling process S6 is performed after the upper half casing preparing process S2 and the upper half diaphragm preparing process S3. In the upper half assembling process S6, the upper half diaphragms 31 are disposed on the inner circumferential side of the upper half casing 41, and the upper half assembly 11 is formed. After the upper half diaphragms 31 are disposed on the inner circumferential side of the upper half casing 41, the upper half vertical position regulating parts 5 are mounted on at least one of the upper half casing 41 and the upper half diaphragm 31. Thereby, in the upper half assembling process S6, the upper half assembly 11 in which positions of the vertical direction Dv and the horizontal direction Dh are regulated such that the central positions of the upper half casing 41 and the upper half diaphragm 31 are aligned in a state in which a predetermined gap is provide between the inner circumferential surface of the upper half casing 41 and the outer circumferential surface of the upper half diaphragm 31 is formed. To be specific, the upper half assembling process S6 of the present embodiment has an upper half casing disposing process S61, an upper half diaphragm disposing process S62, and an upper half vertical position regulating process S63.

In the upper half casing disposing process S61, in a state in which the upper half casing parting planes 41X are directed upward in the vertical direction Dv, the upper half casing 41 is disposed.

In the upper half diaphragm disposing process S62, in a state in which the upper half diaphragm parting planes 31X are directed upward in the vertical direction Dv, the upper half diaphragms 31 are disposed on the inner circumferential side of the upper half casing 41. In the upper half diaphragm disposing process S62 of the present embodiment, in a state in which the upper half spigot parts 310*a* are fitted into the upper half positioning recesses 410*a*, the upper half diaphragms 31 are housed on the inner circumferential side of the upper half casing 41 from above in the vertical direction Dv. In the upper half diaphragm disposing process S62, the upper half diaphragms 31 are disposed to align positions of the upper half casing recesses 411 and the upper half diaphragm recesses 311 to form the housing spaces S. Thereby, positions of the upper half diaphragms 31 in the axial direction Da relative to the upper half casing 41 and positions of the upper half diaphragms 31 in the horizontal direction Dh are regulated.

In the upper half vertical position regulating process S63, positions of the upper half diaphragms 31 in the vertical direction Dv relative to the upper half casing 41 are regulated. The upper half vertical position regulating process S63 is performed after the upper half diaphragm disposing process S62. In the upper half vertical position regulating process S63, the upper half abutting member 51 is provided in the housing space S as the upper half vertical position regulating part 5. In the upper half vertical position regulating process S63, in a state in which at least one of the first upper half casing flat surface 411*a* and the first upper half diaphragm flat surface 311*a* comes into contact with the upper half abutting surface 511, and in a state in which the upper half abutting surface 511 can move in the vertical direction Dv relative to the other of the first upper half casing flat surface 411*a* and the first upper half diaphragm flat surface 311*a*, the upper half abutting member 51 is fixed. In the upper half vertical position regulating process S63 of the present embodiment, in a state in which the upper half abutting surface 511 makes a gap with respect to the first upper half diaphragm flat surface 311*a* while coming into contact with the first upper half casing flat surface 411*a*, the upper half abutting member 51 is fixed to the upper half casing 41. To be specific, in a state in which the threaded part 51B is inserted into the bolt hole formed in the first upper half casing flat surface 411*a* up to a position at which the seating face abuts the first upper half casing flat surface 411*a*, the upper half abutting member 51 is fixed to the upper half casing 41.

The lower half assembling process S7 is performed after the lower half casing preparing process S4 and the lower half diaphragm preparing process S5. In the lower half assembling process S7, the lower half diaphragms 32 are disposed on the inner circumferential side of the lower half casing 42, and the lower half assembly 12 is formed. The lower half assembling process S7 of the present embodiment has a lower half casing disposing process S71 and a lower half diaphragm disposing process S72.

In the lower half casing disposing process S71, in a state in which the lower half casing parting planes 42X are directed upward in the vertical direction Dv, the lower half casing 42 is disposed.

In the lower half diaphragm disposing process S72, in a state in which the lower half diaphragm parting planes 32X are directed upward in the vertical direction Dv, the lower half diaphragms 32 are disposed on the inner circumferential side of the lower half casing 42. In the lower half diaphragm disposing process S72 of the present embodiment, in a state in which the lower half spigot parts are fitted into the lower half positioning recesses, the lower half diaphragms 32 are housed on the inner circumferential side of the upper half casing 41 from above in the vertical direction Dv.

Figure 6:
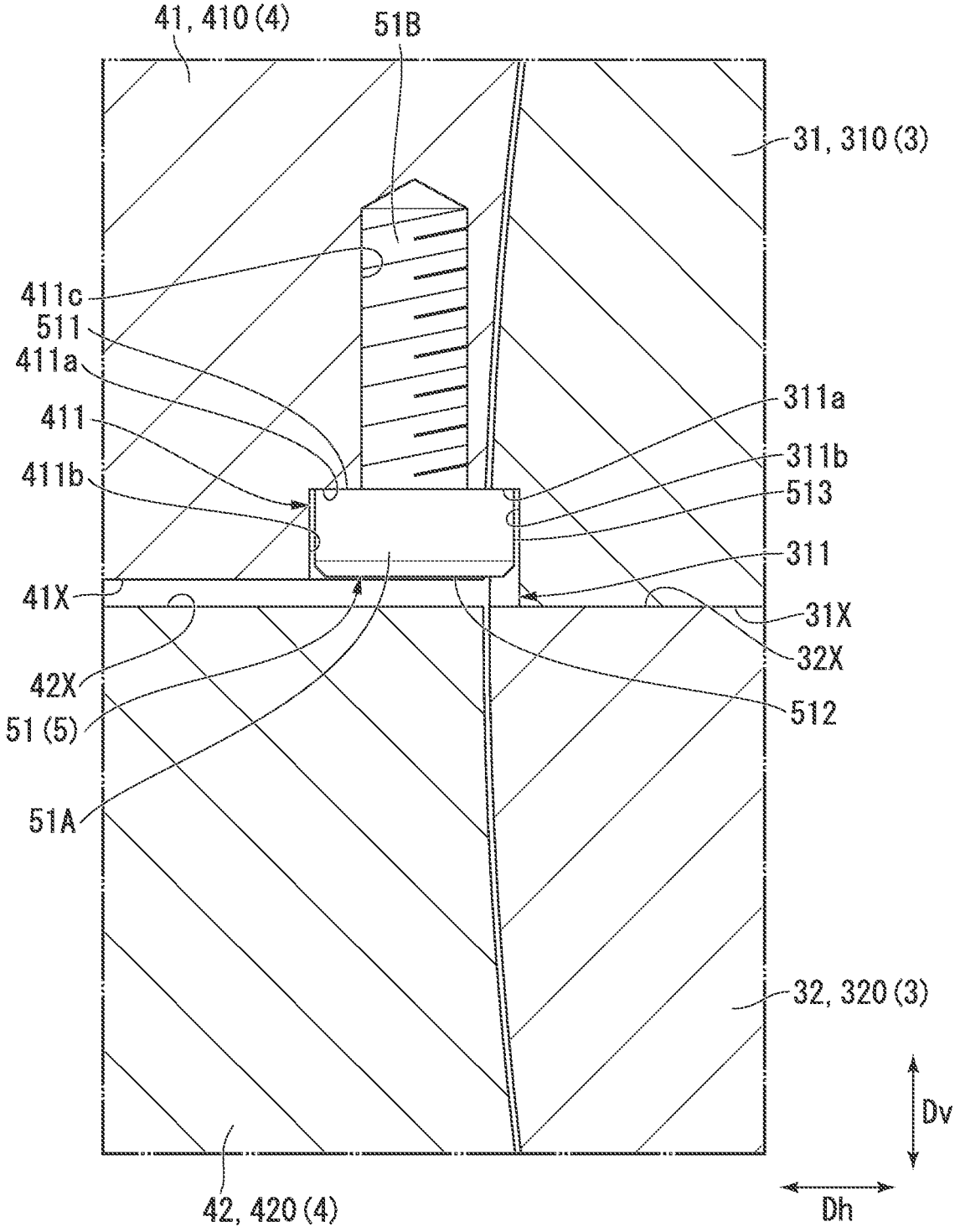
FIG. 6 is an enlarged view of key parts showing a final assembling process of the embodiment of the present disclosure.

In the final assembling process S8, the upper half diaphragm parting planes 31X are brought into contact with the lower half diaphragm parting planes 32X, and the upper half assembly 11 is installed on the lower half assembly 12. To be specific, in the final assembling process S8, the rotor 2 is disposed on the lower half assembly 12. In a state in which the rotor 2 is disposed, the upper half assembly 11 in which the upper half diaphragm parting planes 31X is kept movable relative to the upper half casing parting planes 41X to protrude in the vertical direction Dv is placed on the lower half assembly 12. As shown in FIG. 6, when the upper half assembly 11 is moved relative to the lower half assembly 12 from above in the vertical direction Dv, the lower half diaphragm parting planes 32X and the upper half diaphragm parting planes 31X come into contact with each other before the lower half casing parting planes 42X and the upper half casing parting planes 41X come into contact with each other. Afterward, the upper half assembly 11 is further moved downward relative to the lower half assembly 12 in the vertical direction Dv, and thereby the upper half diaphragm parting planes 31X are pressed against the lower half diaphragm parting planes 32X. Thereby, the upper half diaphragms 31 are moved upward relative to the upper half casing 41 in the vertical direction Dv. As a result, in the state in which the lower half diaphragm parting planes 32X and the upper half diaphragm parting planes 31X are in contact with each other, the lower half casing parting planes 42X and the upper half casing parting planes 41X come into contact with each other. Therefore, in a state in which the upper half casing parting planes 41X come into contact with the lower half casing parting planes 42X, and the upper half diaphragm parting planes 31X also come into contact with the lower half diaphragm parting planes 32X, a compressor is formed.

According to the centrifugal compressor 1, the upper half assembly 11 of the compressor, the upper half diaphragms 31 of the compressor, and the compressor assembling method S1, to combine the upper half assembly 11 and the lower half assembly 12, the upper half diaphragm parting planes 31X and the upper half casing parting planes 41X are directed downward in the vertical direction Dv. The upper half diaphragms 31 are configured to be movable relative to the upper half casing 41. Thereby, the upper half diaphragms 31 are lowered due to deadweight, and the upper half diaphragm parting planes 31X protrude downward from the upper half casing parting planes 41X in the vertical direction Dv. For this reason, when the upper half assembly 11 is placed on the lower half assembly 12, the lower half diaphragm parting planes 32X and the upper half diaphragm parting planes 31X can be brought into contact with each other before the lower half casing parting planes 42X and the upper half casing parting planes 41X come into contact with each other. As a result, in a state in which the upper half diaphragm parting planes 31X and the lower half diaphragm parting planes 32X are reliably in contact with each other, the upper half casing parting planes 41X and the lower half casing parting planes 42X come into contact with each other, and the upper half assembly 11 and the lower half assembly 12 are combined. Therefore, only by placing the upper half assembly 11 on the lower half assembly 12, the lower half diaphragm parting planes 32X and the upper half diaphragm parting planes 31X as well as the lower half casing parting planes 42X and the upper half casing parting planes 41X can come into contact with each other with high accuracy. Thereby, the occurrence of the gap between the parting planes of the diaphragm 3 is suppressed while reducing adjustment work for positioning, and the upper half assembly 11 and the lower half assembly 12 can be assembled.

In the state in which the first upper half casing flat surface 411*a* and the upper half abutting surface 511 are in contact with each other, and in the state in which the upper half abutting surface 511 makes a gap with respect to the first upper half diaphragm flat surface 311*a*, the upper half abutting member 51 is fixed. For this reason, the first upper half casing flat surface 411*a* is made immovable relative to the upper half abutting surface 511, and the first upper half diaphragm flat surface 311*a* is made movable relative to the upper half abutting surface 511. Thereby, by means of the upper half abutting member 51, the upper half diaphragm parting planes 31X is kept movable relative to the upper half casing parting planes 41X to protrude in the vertical direction Dv. That is, only by mounting the upper half abutting member 51 on the upper half casing 41, the upper half diaphragms 31 can be made movable relative to the upper half casing 41 in a state in which the upper half casing 41 and the upper half diaphragms 31 are put together. Therefore, the adjustment work for positioning can be performed only by fixing the upper half abutting member 51, thereby the work load can be reduced.

Since the upper half abutting member 51 is the bolt member, an amount of relative movement of the first upper half diaphragm flat surface 311*a* relative to first upper half casing flat surface 411*a* can be restricted using the seating face of the head part 51A of the bolt member. Thereby, the relative movement of the upper half diaphragm parting planes 31X relative to the upper half casing parting planes 41X in the vertical direction Dv can be restricted by a simple configuration.

Furthermore, when the upper half abutting member 51 is mounted, the threaded part 51B is inserted into the bolt hole formed in the first upper half casing flat surface 411*a* up to a position at which the seating face abuts the first upper half casing flat surface 411*a*. For this reason, there is no need to finely adjust a position of the upper half abutting surface 511 for the first upper half casing flat surface 411*a*. For this reason, the upper half abutting member 51 can be easily mounted on the upper half casing 41.

The head part 51A of the upper half abutting member 51 that is the bolt member is disposed in the housing space S. For this reason, the upper half abutting member 51 is disposed not to protrude from the upper half casing parting plane 41X and the upper half diaphragm parting plane 31X. Therefore, when the upper half assembly 11 and the lower half assembly 12 are combined, it is possible to prevent the upper half abutting member 51 from being disposed at an interfering position between the lower half diaphragm parting plane 32X and the upper half diaphragm parting plane 31X or between the lower half diaphragm parting plane 32X and the upper half diaphragm parting plane 31X. For this reason, when the upper half assembly 11 and the lower half assembly 12 are combined, it is possible to prevent the upper half abutting member 51 from being obstacles.

The upper half diaphragm recesses 311 are formed to be deeper than the upper half casing recesses 411. In addition, an amount of relative movement of the upper half diaphragm parting plane 31X relative to the upper half casing parting plane 41X in the vertical direction Dv can be adjusted only by changing the depth of the upper half diaphragm recess 311.

Especially, the first upper half casing flat surface 411*a* and the upper half casing parting plane 41X are formed in parallel, and the first upper half diaphragm flat surface 311*a* and the upper half diaphragm parting plane 31X are formed in parallel. For this reason, only by adjusting positions of the parallel surfaces of the first upper half casing flat surface 411*a* and the upper half casing parting plane 41X in the vertical direction Dv and positions of the parallel surfaces of the first upper half diaphragm flat surface 311*a* and the upper half diaphragm parting plane 31X in the vertical direction Dv, positions of the upper half casing parting plane 41X and the upper half diaphragm parting plane 31X when the upper half abutting member 51 is mounted are adjusted. Thereby, the amount of protrusion of the upper half diaphragm parting plane 31X relative to the upper half casing parting plane 41X can be delicately adjusted with ease.

In the upper half vertical position regulating process S63, in the state in which the upper half casing parting planes 41X and the upper half diaphragm parting planes 31X are directed upward in the vertical direction Dv, the upper half abutting members 51 are mounted in the upper half casing 41. For this reason, a worker can mount the upper half abutting members 51 in the upper half casing 41 and the upper half diaphragms 31 from above in the vertical direction Dv. Therefore, when the upper half abutting members 51 are fixed to the upper half casing 41, there is no need to do work to sneak into the upper half diaphragms 31 and the upper half casing 41 from below in the vertical direction Dv. As a result, the upper half abutting members 51 can be easily mounted in the upper half casing 41 and the upper half diaphragms 31.

Another Modified Examples of the Embodiment

The upper half vertical position regulating part 5 is not limited to being provided on the upper half spigot part 310*a*. The upper half vertical position regulating part 5 may be provided in accordance with a position of a fixture such as a bolt that fixes the upper half casing 41 and the lower half casing 42. Therefore, when the upper half vertical position regulating part 5 is provided at a position away from the upper half spigot part 310*a*, the upper half diaphragm recess 311 or the upper half casing recess 411 may be formed at a position away, in the axial direction Da, from the position at which the upper half spigot part 310*a* is formed.

The upper half vertical position regulating part 5 is not limited to having only the upper half abutting member 51 that is the bolt member, and may have a plurality of members including a frame in which the upper half abutting surface 511 is formed.

While preferred embodiments of the disclosure have been described and shown above, it should be understood that these are exemplary of the disclosure and are not to be considered as limiting. Additions, omissions, substitutions, and other modifications can be made without departing from the spirit or scope of the present disclosure. Accordingly, the disclosure is not to be considered as being limited by the foregoing description, and is only limited by the scope of the appended claims.

What is claimed is:

1. A compressor comprising:

an upper half casing extending in a circumferential direction of a rotor that is rotatable about an axis and having upper half casing parting planes that are horizontal planes facing downward in a vertical direction at opposite ends thereof in the circumferential direction;

a lower half casing extending in the circumferential direction and having lower half casing parting planes that come into contact with the upper half casing parting planes at opposite ends thereof in the circumferential direction;

upper half diaphragms extending in the circumferential direction, configured to be disposed on an inner circumferential side of the upper half casing, and having upper half diaphragm parting planes that are horizontal planes facing downward in the vertical direction at opposite ends thereof in the circumferential direction;

lower half diaphragms extending in the circumferential direction, configured to be disposed on an inner circumferential side of the lower half casing, and having lower half diaphragm parting planes that come into contact with the upper half diaphragm parting planes at opposite ends thereof in the circumferential direction; and upper half position regulating parts configured to regulate positions of the upper half casing and the upper half diaphragms in a state in which the upper half diaphragm parting planes are movable relative to the upper half casing parting planes to protrude in the vertical direction, wherein the upper half casing has upper half casing recesses that are recessed upward on inner circumferential sides of the upper half casing parting planes in the vertical direction such that upper half casing recessed surfaces directed in a direction including the vertical direction are formed, wherein each of the upper half diaphragms has upper half diaphragm recesses that are recessed upward on outer circumferential sides of the upper half diaphragm parting planes in the vertical direction such that upper half diaphragm recessed surfaces directed in the direction including the vertical direction are formed, and that form housing spaces communicating with the upper half casing recesses when disposed on the inner circumferential side of the upper half casing, wherein the upper half position regulating parts are fixed to at least one of the upper half casing and one of the upper half diaphragms in the housing spaces, and have upper half abutting members at which upper half abutting surfaces, each of which comes into contact with the upper half casing recessed surface and the upper half diaphragm recessed surface, are formed, wherein the upper half abutting members are fixed to the upper half casing in a state in which each of the upper half abutting surfaces is in contact only with the upper half casing recessed surface and makes a gap with respect to the upper half diaphragm recessed surface, wherein each of the upper half abutting members is a bolt member in which the upper half abutting surface becomes a seating face, and is inserted into and fixed in a bolt hole formed in the upper half casing recessed surface, wherein the upper half diaphragm recess is recessed from the upper half diaphragm to have an arc shape when viewed from the upper half diaphragm parting plane side, wherein a depth of the upper half diaphragm recess is deeper than that of the upper half casing recess.

2. An upper half assembly of a compressor comprising:

an upper half casing extending in a circumferential direction of a rotor that is rotatable about an axis and having upper half casing parting planes that are horizontal planes facing downward in a vertical direction at opposite ends thereof in the circumferential direction;

upper half diaphragms extending in the circumferential direction, configured to be disposed on an inner circumferential side of the upper half casing, and having upper half diaphragm parting planes that are horizontal planes facing downward in the vertical direction at opposite ends thereof in the circumferential direction; and upper half position regulating parts configured to regulate positions of the upper half casing and the upper half diaphragms in a state in which the upper half diaphragm parting planes are movable relative to the upper half casing parting planes to protrude in the vertical direction, wherein the upper half casing has upper half casing recesses that are recessed upward on inner circumferential sides of the upper half casing parting planes in the vertical direction such that upper half casing recessed surfaces directed in a direction including the vertical direction are formed, wherein each of the upper half diaphragms has upper half diaphragm recesses that are recessed upward on outer circumferential sides of the upper half diaphragm parting planes in the vertical direction such that upper half diaphragm recessed surfaces directed in the direction including the vertical direction are formed, and that form housing spaces communicating with the upper half casing recesses when disposed on the inner circumferential side of the upper half casing, wherein the upper half position regulating parts are fixed to at least one of the upper half casing and one of the upper half diaphragms in the housing spaces, and have upper half abutting parts at which upper half abutting surfaces, each of which comes into contact with the upper half casing recessed surface and the upper half diaphragm recessed surface, are formed, wherein the upper half abutting parts are fixed to the upper half casing in a state in which each of the upper half abutting surfaces is in contact with the upper half casing recessed surface and makes a gap with respect to the upper half diaphragm recessed surface, wherein each of the upper half abutting parts is a bolt member in which the upper half abutting surface becomes a seating face, and is inserted into and fixed in a bolt hole formed in the upper half casing recessed surface, wherein the upper half diaphragm recess is recessed from the upper half diaphragm to have an arc shape when viewed from the upper half diaphragm parting plane side, wherein a depth of the upper half diaphragm recess is deeper than that of the upper half casing recess.

3. A compressor assembling method comprising:

an upper half casing preparing process of preparing an upper half casing that extends in a circumferential direction of a rotor that is rotatable about an axis and has upper half casing parting planes that are horizontal planes facing downward in a vertical direction at opposite ends thereof in the circumferential direction;

a lower half casing preparing process of preparing a lower half casing that extends in the circumferential direction and has lower half casing parting planes that come into contact with the upper half casing parting planes at opposite ends thereof in the circumferential direction;

an upper half diaphragm preparing process of preparing upper half diaphragms that extend in the circumferential direction, are configured to be disposed on an inner circumferential side of the upper half casing, and have upper half diaphragm parting planes that are horizontal planes facing downward in the vertical direction at opposite ends thereof in the circumferential direction;

a lower half diaphragm preparing process of preparing lower half diaphragms that extend in the circumferential direction, are configured to be disposed on an inner circumferential side of the lower half casing, and have lower half diaphragm parting planes that come into contact with the upper half diaphragm parting planes at opposite ends thereof in the circumferential direction;

an upper half assembling process of mounting upper half position regulating parts, which keep the upper half casing and the upper half diaphragms movable relative to each other such that the upper half diaphragm parting planes protrude in the vertical direction with respect to the upper half casing parting planes after the upper half diaphragms are disposed on the inner circumferential side of the upper half casing, on at least one of the upper half casing and one of the upper half diaphragms and forming an upper half assembly;

a lower half assembling process of disposing the lower half diaphragms on the inner circumferential side of the lower half casing and forming a lower half assembly; and a final assembling process of bringing the upper half diaphragm parting planes into contact with the lower half diaphragm parting planes and installing the upper half assembly on the lower half assembly;

wherein in the final assembling process, the upper half assembly in which the upper half diaphragm parting planes are protruded in the vertical direction relative to the upper half casing parting planes is placed on the lower half assembly, afterward, the lower half casing parting planes and the upper half casing parting planes come into contact with each other, after the lower half diaphragm parting planes and the upper half diaphragm parting planes are in contact with each other.

* * * * *